US005497543A

United States Patent [19]

Cavender et al.

[11] Patent Number: 5,497,543

[45] Date of Patent: Mar. 12, 1996

[54] DOLL MAKING METHOD

[76] Inventors: D. Lea Cavender, 2825 Top Rd., Sevierville, Tenn. 37862; Tina L. B. Slater, 211 Harmony St., Commerce, Ga. 30529

[21] Appl. No.: 457,625

[22] Filed: Jun. 1, 1995

[51] Int. Cl.[6] ..... B23P 21/00; A63H 3/36

[52] U.S. Cl. ..... 29/469; 446/385

[58] Field of Search ..... 29/464, 467, 469, 29/805; 446/268, 369, 318, 385, 387, 388, 488, 490, 487; 428/4, 5, 7, 16; 156/61

[56] References Cited

U.S. PATENT DOCUMENTS

| | | | |
|---|---|---|---|
| D. 234,467 | 3/1975 | Del Grosso | 428/4 |
| 940,801 | 11/1909 | Goldberg | 446/385 |
| 2,587,502 | 2/1952 | McMahon | 428/5 |
| 4,321,291 | 3/1982 | Brownell | 446/388 |
| 4,921,460 | 5/1990 | Lin | 446/369 |
| 4,957,786 | 9/1990 | Barboza | 446/388 |

*Primary Examiner*—David P. Bryant
*Attorney, Agent, or Firm*—Pitts & Brittian

[57] ABSTRACT

A doll making method. The method of the present invention includes the steps of forming ribbon material (10) into a plurality of first loops (32) disposed on opposite sides of a first gathered portion (34) of the ribbon material (10), and then folding the ribbon material (10) proximate the first gathered portion (34) whereby the first loops (32) are adjacently disposed so as to define a skirt-like configuration. The remaining ribbon material (10) is then formed into a plurality second loops (40) which are disposed on opposite sides of a second gathered portion (42) of ribbon material so as to produce first and second oppositely disposed wing-like portions (36, 38). The first and second gathered portions (34, 42) of ribbon material (10) are then secured together and a head member (50) is secured to the ribbon material (10) proximate the first and second gathered portions (34, 42) of ribbon material (10).

17 Claims, 7 Drawing Sheets

DOLL MAKING METHOD

TECHNICAL FIELD

This invention relates a method for making dolls utilizing a ribbon fabricating material and certain other accessories. In this particular invention the doll defines a body including a skirt portion and oppositely disposed wing-like portions fabricated of ribbon material and defines a head member secured thereto.

BACKGROUND ART

Whereas the manufacturing of dolls is, for the most part, accomplished by complex machinery in toy manufacturing facilities, the making of hand-made dolls has survived as a hobby and pastime, and as a craft that can be performed on a small scale to generate income. However, the construction of aesthetically pleasing hand-made dolls generally requires substantial artistic talent and extensive practice. Various doll making kits have been marketed which provide detailed instructions which attempt to aid the unskilled in the making of dolls, but generally skills, such as sewing skills, are still required, and the detailed instructions leave little room for creativity. Thus, doll making is an endeavor which has generally been successfully pursued only by those with both the necessary artistic talent and the time to become practiced in the endeavor.

Therefore, it is an object of the present invention to provide a doll making method which produces aesthetically pleasing dolls without complex machinery.

It is another object of the present invention to provide doll making method which can be used by those who do not possess special skills in the doll making art.

Yet another object of the present invention is to provide a doll making method which utilizes ribbon as a fabricating material, and which produces a doll having an angel-like appearance.

Still another object of the present invention is to provide a doll making method which produces aesthetically pleasing dolls inexpensively and with material which are readily available.

SUMMARY OF THE INVENTION

The present invention provides a doll making method which produces a doll defining a skirt and first and second wing-like portions. In accordance with the method of the present invention the skirt of the doll is produced by forming a plurality of first loops of ribbon material, with such first loops being disposed on opposite sides of a first gathered portion of the ribbon material. The ribbon material is then folded proximate the first gathered portion such that the first loops are adjacently disposed in a skirt-like configuration. The first and second wing-like portions are produced by forming a plurality of second loops of ribbon material disposed on opposite sides of a second gathered portion of ribbon material. The first and second gathered portions of ribbon material are then secured together with a binding member, thereby securing the wing-like portions to the skirt of the doll. A head member is then secured to the ribbon material proximate the first and second gathered portions of ribbon material. In certain applications of the method of the present invention a bodice is secured over a shoulder portion of the head member and about the first and second gathered portions of ribbon material, and a belt member is secured about the bodice to form the doll's waist.

BRIEF DESCRIPTION OF THE DRAWINGS

The above mentioned features of the invention will be more clearly understood from the following detailed description of the invention read together with the drawings in which.

BEST MOST FOR CARRYING OUT THE INVENTION

Figure 1A:
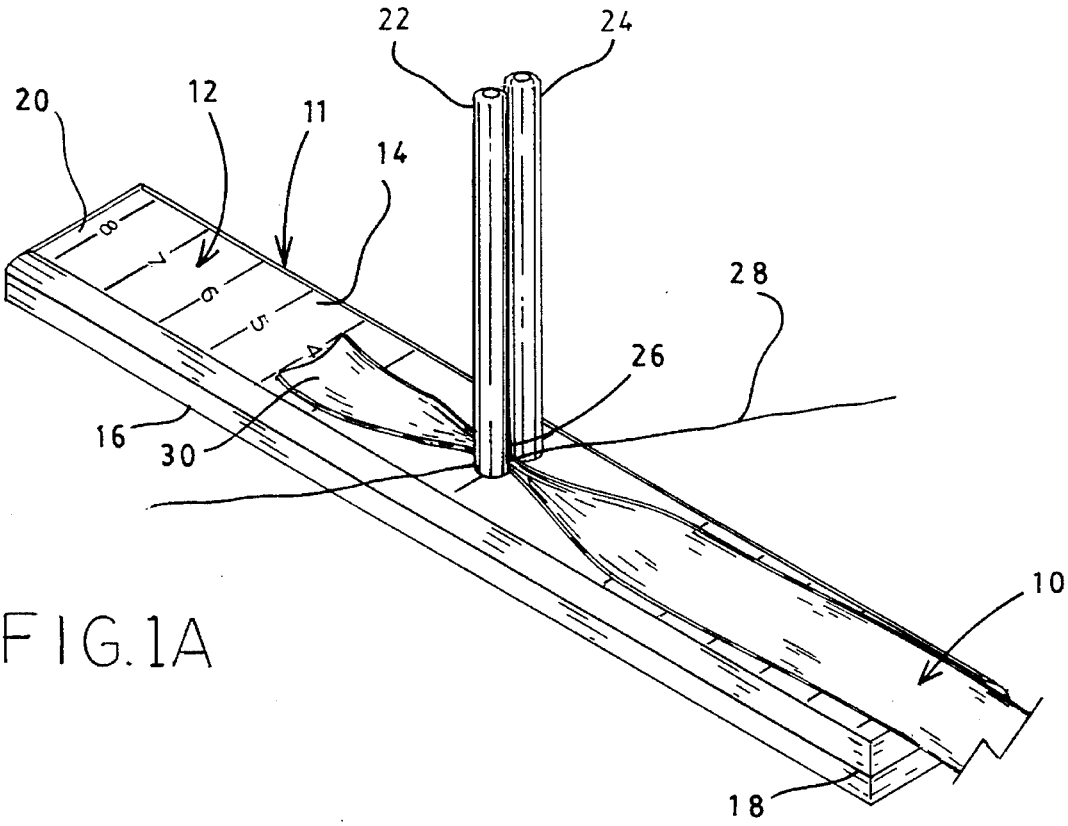
FIG. 1A illustrates a perspective view of a bow making apparatus used in the preferred application of the method of the present invention, and depicts a binding member and ribbon fabricating material supported thereon in accordance with the method of the present invention.

The various steps of the doll making method of the present invention are illustrated general in FIGS. 1A–4. As will be discussed further below, the preferred application of the method of the present invention contemplates the use of decorative ribbon as a fabricating material for forming the body of the doll, such as, for example, the illustrated ribbon 10. However, it will be understood that long, flexible strips of various woven, or non-woven, materials such as cloth or plastic can be used, and references to "ribbon" herein are intended to include any such fabricating materials.

Further, in the preferred application of the method of the present invention, a bow making apparatus illustrated generally at 11 in FIGS. 1A–2B is utilized to maintain the position of the bow fabricating material during certain steps of the method. The apparatus 11 includes a base member 12 having a substantially planar upper work surface 14, and a lower surface 16 for supporting the apparatus 11 on a table or other support surface. The base member 12 has first and second opposite ends 18 and 20, respectively, and mounted therebetween are at least a pair of retainer members 22 and 24 which are selectively spaced so as to define a retaining gap 26 for releasably receiving the ribbon 10. It will, however, be recognized from the discussion below that other retaining mechanisms can be utilized to maintain the desired position of the doll fabricating material during the manufacture of the doll and the apparatus 11 is simply illustrative of a preferred retaining apparatus.

In accordance with the preferred application of the doll making method of the present invention, a binding member 28 is inserted between the retainer members 22 and 24 of the apparatus 11 such that a preselected length of the binding member extends outwardly on either side of the gap 26 as illustrated in FIG. 1A. The binding member 28 preferably defines a length of flexible wire, but thread, string, or other mechanical clamp members can be used if desired. The first end portion 30 of a length of ribbon 10 is then inserted between the retainer members 22 and 24 such that the ribbon 10 is maintained between the retainer members 22 and 24 in a gathered disposition. In this regard, the retainer members 22 and 24 facilitate the holding of the ribbon 10 during manufacture, but as discussed above, the gathered disposition can be maintained by other mechanisms, or the gathered disposition of the ribbon can be maintained by holding the ribbon 10 in a gathered disposition between ones fingers.

Figure 1B:
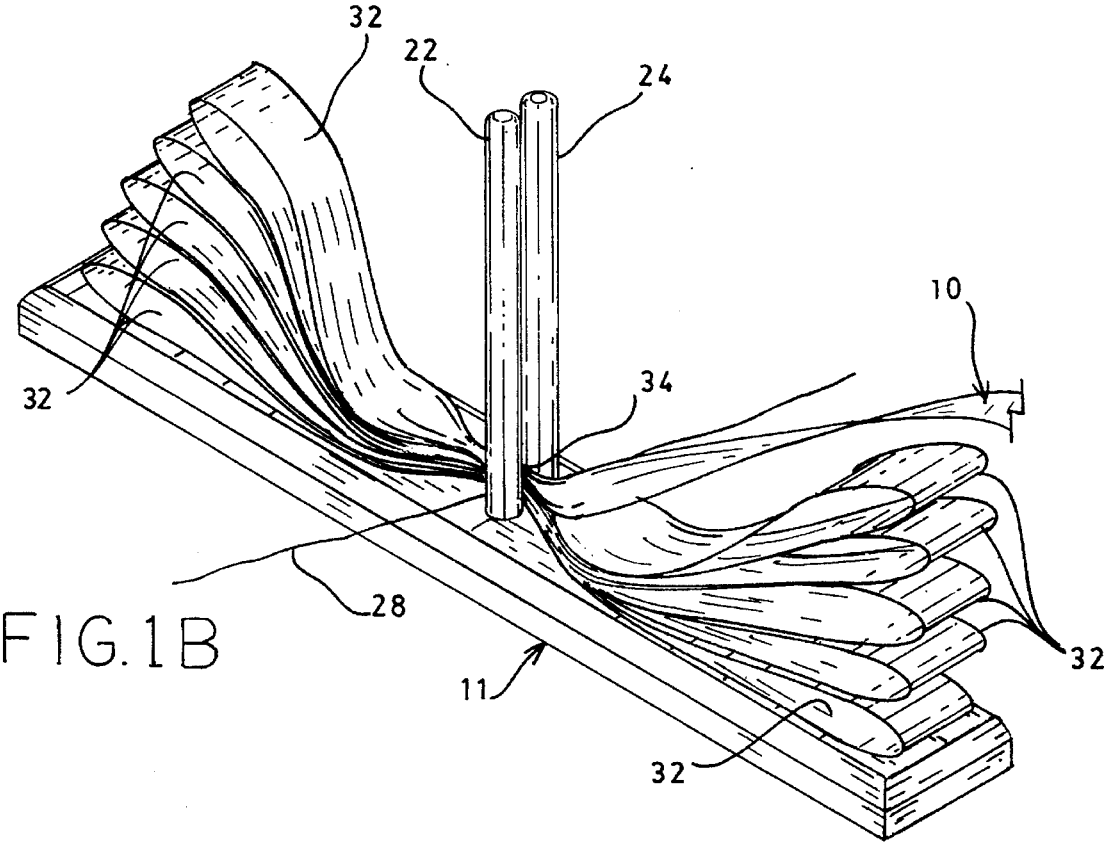
FIG. 1B illustrates a perspective view of a bow making apparatus used in the preferred application of the method of the present invention, and depicts the ribbon material supported thereon formed into first loops in accordance with the method of the present invention.

As illustrated in FIG. 1B, with the first end portion 30 releasably secured between the retainer members 22 and 24, a plurality of overlapping folds are made in the ribbon 10 with the ribbon being gathered between the folds and inserted in the gap 26 so as to produce a plurality of first loops 32 formed on either side of the retainer members 22 and 24. The forming of between four and six first loops 32 on either side of the retainer members 22 and 24 is generally sufficient, but other numbers of loops may be formed if desired. In this regard, variations in the width of the ribbon fabricating material used may necessitate variations in the number of first loops 32 required to produce an aesthetically pleasing appearance.

Figure 1C:
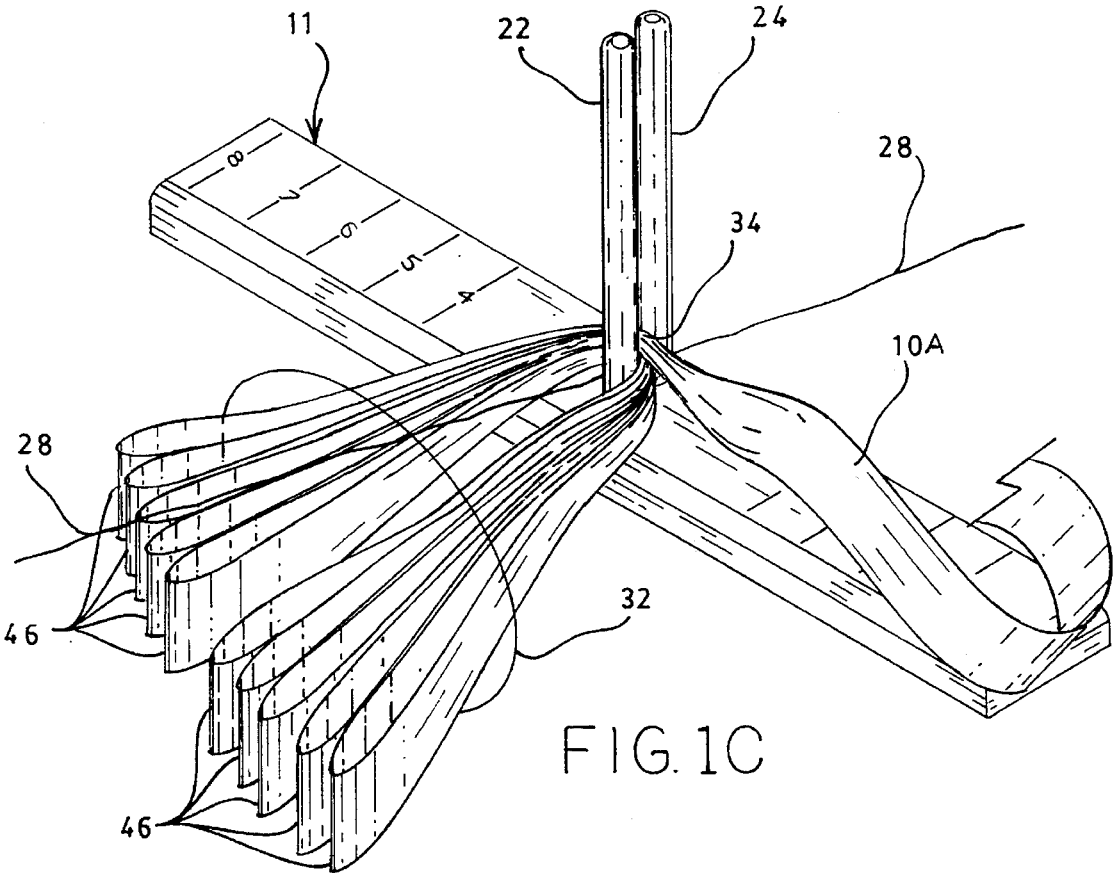
FIG. 1C illustrates a perspective view of a bow making apparatus used in the preferred application of the method of the present invention, and depicts the ribbon material supported thereon formed into first loops and folded to form a skirt-like configuration in accordance with the method of the present invention.

The oppositely disposed first loops 32 are then moved together as illustrated in FIG. 1C by bending the looped ribbon 10 at the gathered portion 34 of the ribbon 10 and moving the first loops 32 into a substantially adjacent disposition such that the various first loops 32 are oriented in substantially the same direction. As will become clearer from the discussion which follows, the first loops 32 form the skirt of a doll made in accordance with the present method.

Figure 2A:
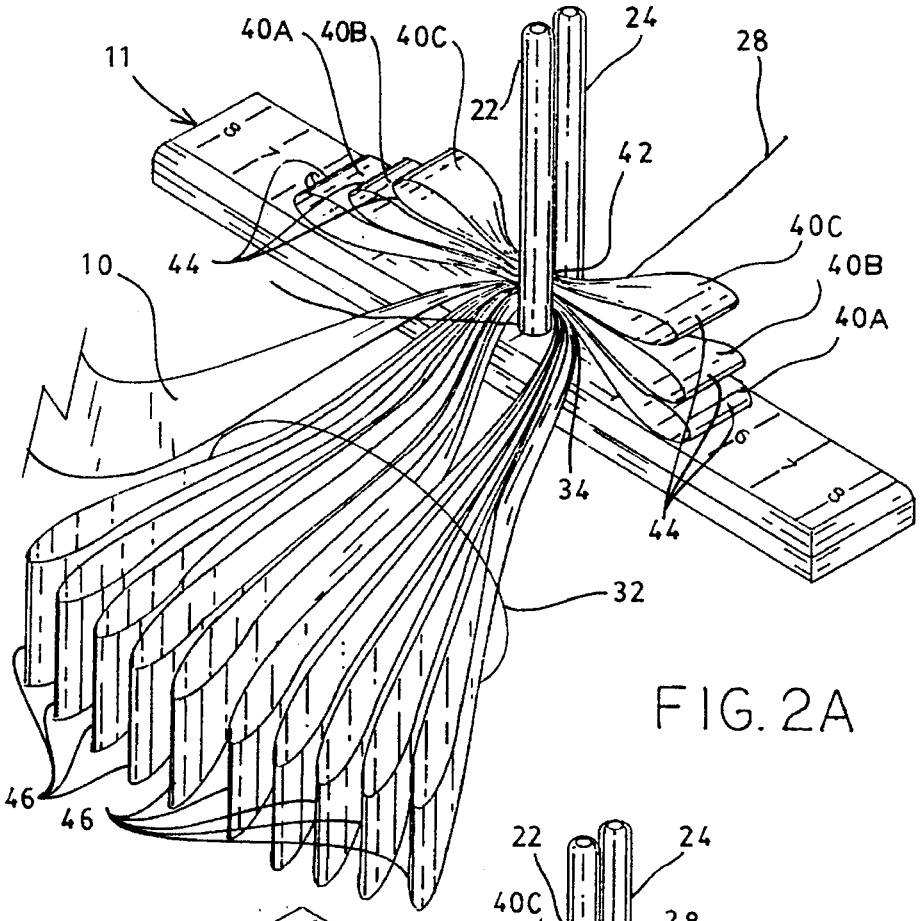
FIG. 2A illustrates a perspective view of a bow making apparatus used in the preferred application of the method of the present invention, and depicts the ribbon material supported thereon formed into second loops in accordance with the method of the present invention.

As illustrated in FIG. 1C, after the first loops 32 are formed, the remaining ribbon, referenced at 10A in FIG. 1C, remains available for the forming of a pair of oppositely disposed wing-like portions 36 and 38. (e.g. see FIG. 3A) As illustrated in FIG. 2A, the wing-like portions 36 and 38 are constructed by forming a plurality of second loops 40A–C on either side of the retainer members 22 and The second loops 40A–C are formed in the same manner as described above with respect to the first loops 32. However, the length of the second loops 40A–C, i.e. the distance from the gathered portion 42 to the distal end 44 of the second loops 40, is less than the length of the first loops 32, i.e. the distance from the gathered portion 34 and distal end 46 of the loops 32. Moreover, in the preferred application of the method of the present invention, the second loops 40A–C differ in length. For example, in the construction of a typical doll, the first oppositely disposed pair of loops 40A is formed defining a first length, the second pair of loops 40B is formed defining a second length, and the third pair of loops 40C is formed defining a third length. Of course, the number of pairs of second loops 40 which are formed is a matter of preference, and the width of the ribbon 10 used may make the formation of more or fewer pairs of second loops 40 desirable.

With respect to the relative lengths of the first loops 32 and the second loops 40A–C, it will be appreciated that this is a matter of preference, and the variation of the relative lengths of the loops 32 and 40 allow interesting variations in the proportions of the resulting doll. However, by way of example, in a typical application of the method of the present invention, if the first loops 32 are formed to define lengths of approximately ten inches, the length of the second loops 40A could be approximately six inches, the length of the second loops 40B could be approximately five inches, and the length of the second loops 40C could be approximately four inches. Such relative lengths of the loops 32 and 40 produce a well proportioned, aesthetically pleasing doll.

Figure 2B:
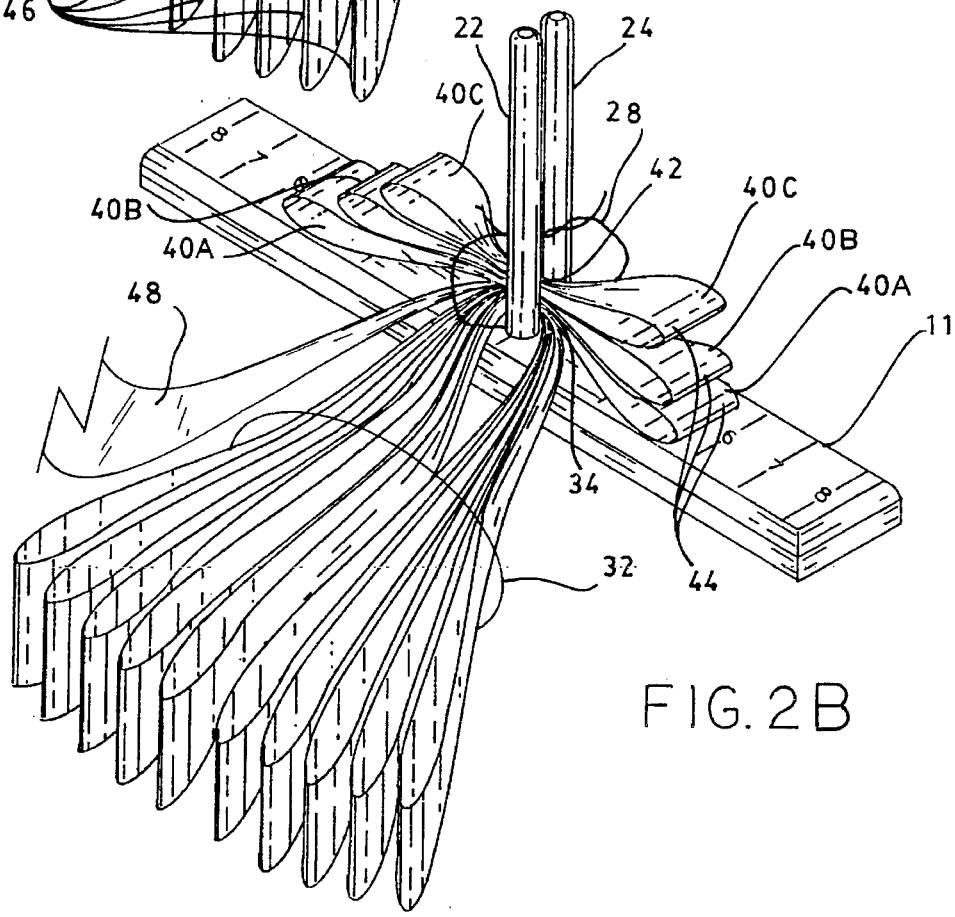
FIG. 2B illustrates a perspective view of a bow making apparatus used in the preferred application of the method of the present invention, and depicts the ribbon material supported thereon being bound together with a binding member in accordance with the method of the present invention.
Figures 2C, 2D:
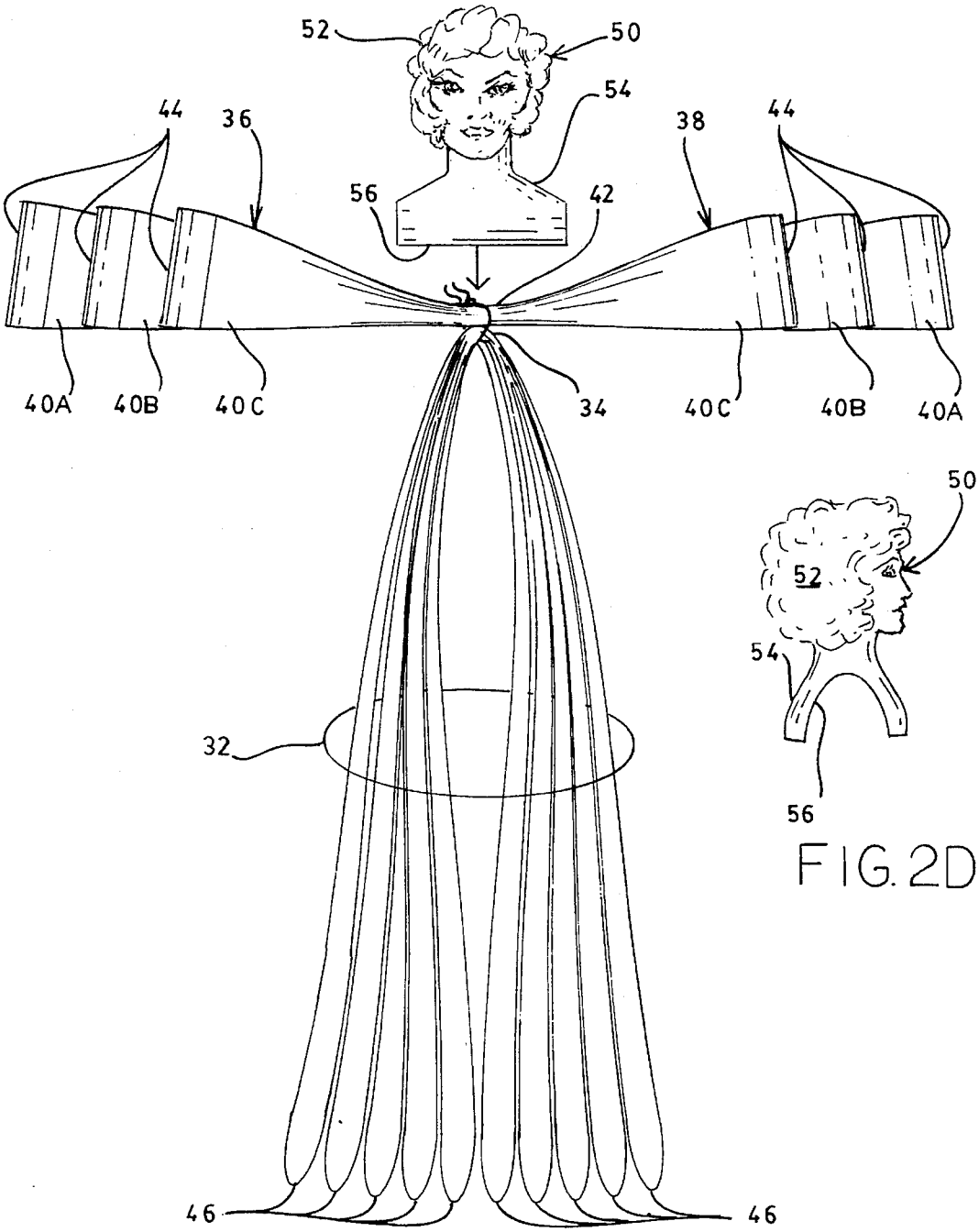
FIG. 2C illustrates a front elevation view depicting a head member being secure to the first and second gathered portions of ribbon material in accordance with the method of the present invention.
FIG. 2D illustrates a side elevation view of a head member used in the method of the present invention.

After the loops 32 and 40A–C have been formed, the binding member 28 is utilized to bind the ribbon 10 at the gathered portions 34 and 42. Where the binding member 28 comprises a length of wire, the binding member 28 is wrapped around the gathered portions 34 and 42 and twisted or tied in position as illustrated in FIG. 2B. Further, any excess ribbon 10 can be trimmed and the free end 48 of the ribbon can positioned so as to be oriented in the same general direction as the first loops 32 as illustrated in FIG. 2B, thereby becoming a component of the skirt of the doll.

Once the loops 32 and 40 have been bound with the binding member 12, the gathered portions 34 and 42 can be removed from between the retainer members 22 and 24. A head member, such as the illustrated head member 50, is then secured proximate the gathered portions 34 and 42. In the preferred application of the method of the present invention, the head member 50 includes a head portion 52 and a shoulder portion 54 with the shoulder portion 54 defining a lower groove 56 which receives the gathered portions 34 and 42. In the preferred application of the method an adhesive, such glue applied with a hot glue gun, is applied to the gathered portions 34 and 42, and/or the interior surfaces of the groove 56 to secure the head member 50 to the ribbon proximate the gathered portions 34 and 42.

It will be recognized by those skilled in the doll making art that the illustrated head member 50 is merely illustrative of one preferred head member configuration. In this regard, various head depictions and/or head and shoulder combinations are marketed for the making of dolls and various of these products would be suitable for securing to the gathered portions 34 and 42.

Figure 3A:
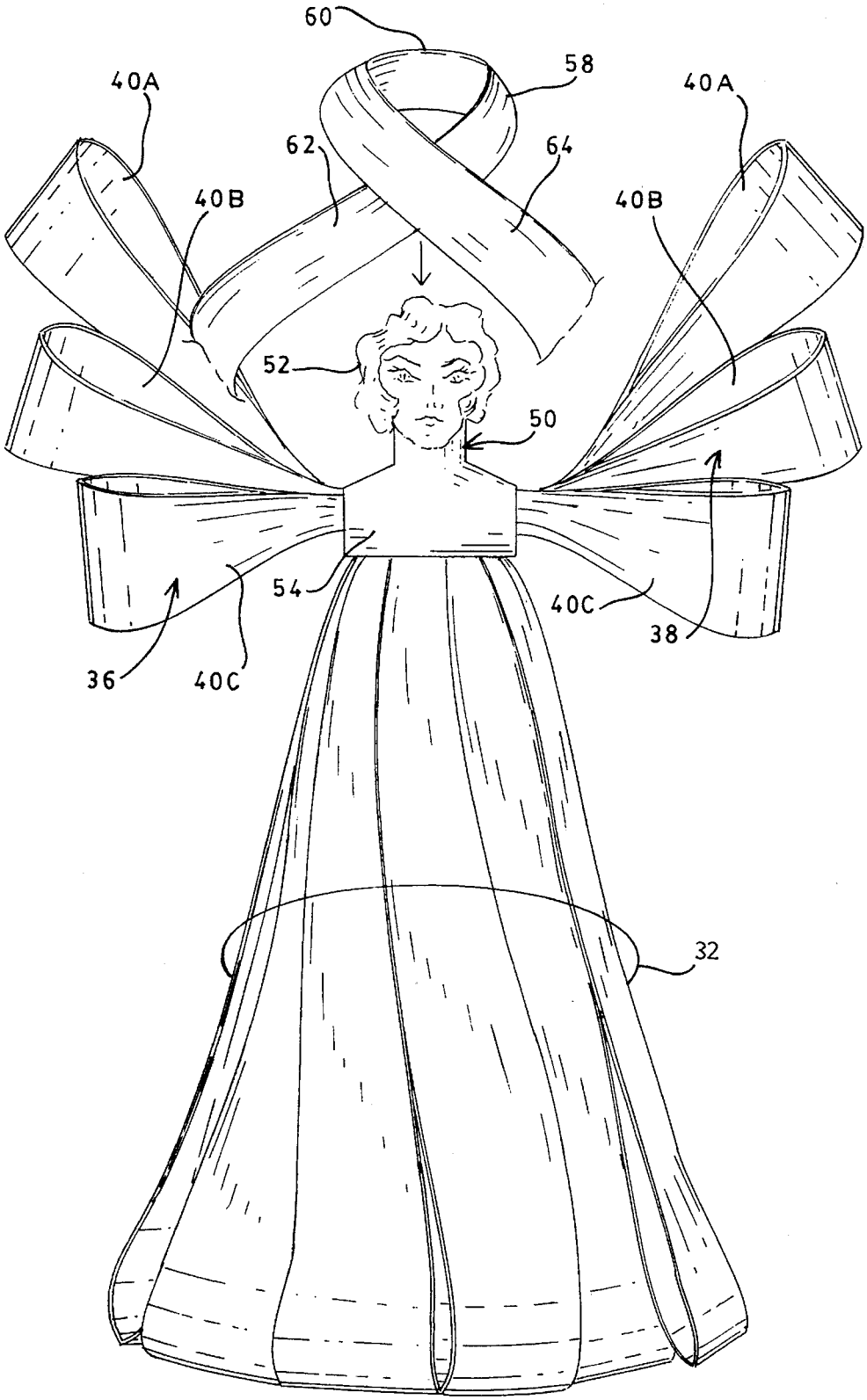
FIG. 3A illustrates a front elevation view of a bodice member being secured about the head member of the doll in accordance with the method of the present invention.
Figure 3B:
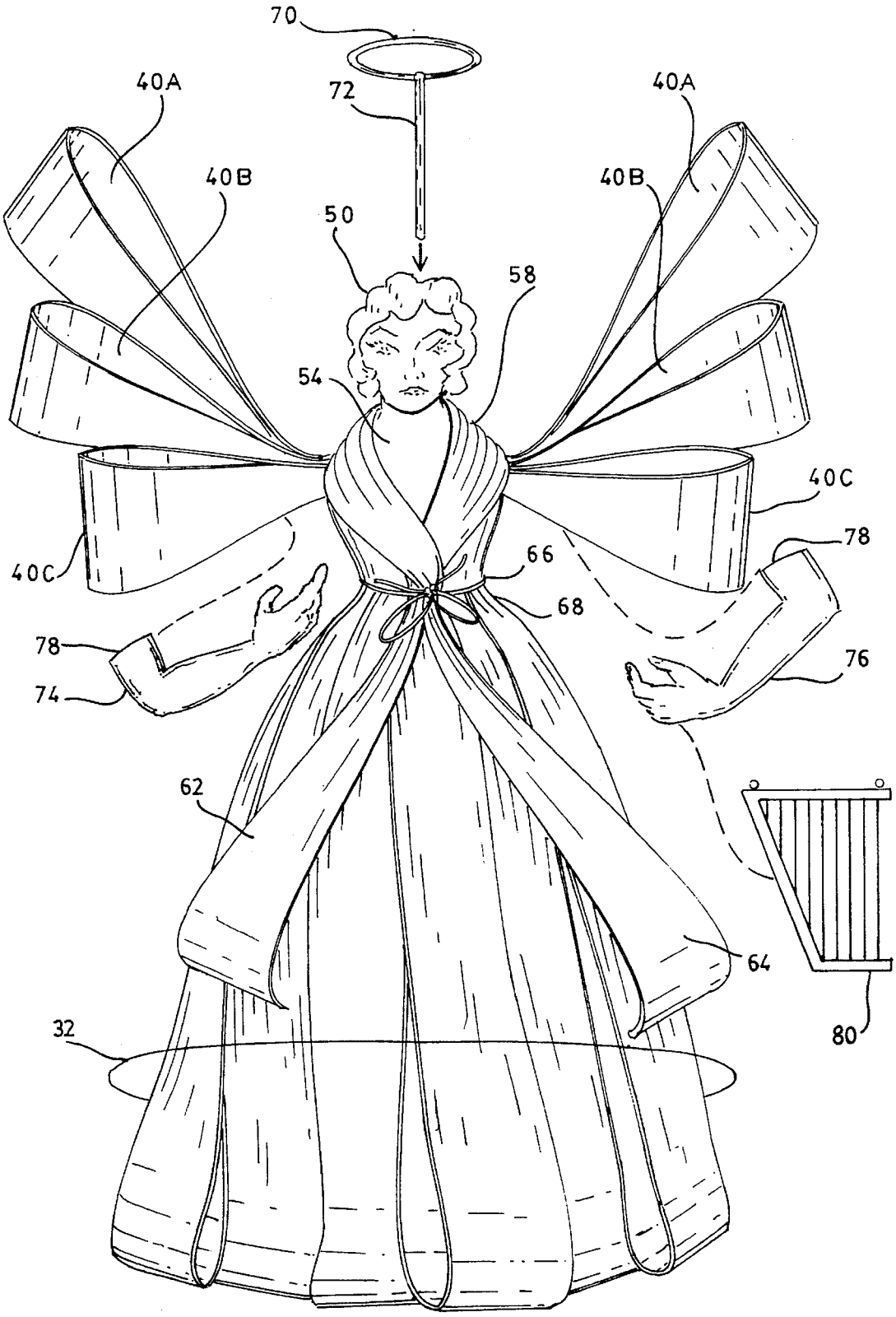
FIG. 3B illustrates a front elevation view of a doll made in accordance with the method of the present invention, and depicts the optional steps of securing arm members, a halo member and/or a harp to the doll.
Figure 4:
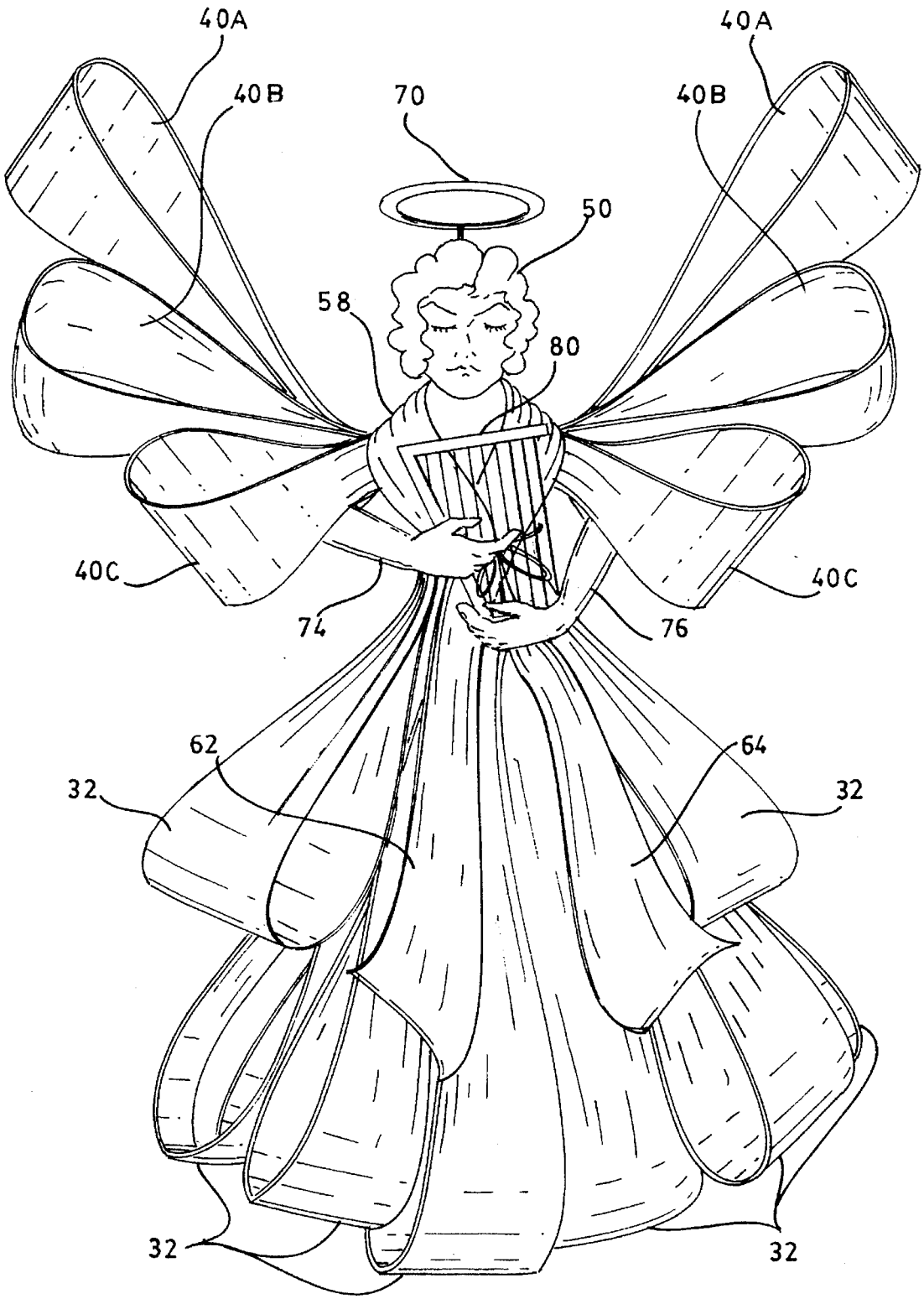
FIG. 4 illustrates a front elevation view of a doll made in accordance with the method of the present invention.

As noted above, the first loops 32 serve to define the skirt of the doll and the second loops 40A–C form the wing-like portions 36 and 38 of the doll. In this regard, at any point after the gathered portions 34 and 42 have been bound with the binding member 28 the loops 32 and 40 can be selectively positioned to produce the desired representation of skirt and wings. For example, as illustrated in FIGS. 3A–4 the first loops 32 can be generally arranged in a circular pattern to give the appearance of a skirt. Further, the second loops 40A–C can be placed in a fanned disposition with the loops 40A in the uppermost position, with the loops 40B disposed in an intermediate position, and the loops 40C disposed in the lowest position, thereby giving the appearance of wings. It will be recognized by those skilled in the art that the use of ribbon 10 provided with bendable wire along its opposite edges facilitates the desired positioning of the loops 32 and 40A–C. However, such wire reinforced ribbon is not necessary to the construction of a doll in accordance with the method of the present invention.

After the head member 50 is attached to the gathered portions 34 and 42, a bodice member 58 is placed around the head member. In the preferred application of the method of the present invention, the bodice member 58 defines a second length of ribbon, a central portion 60 of which engages the back of the shoulder portion 54. Further, the bodice member 58 defines opposite end portions 62 and 64 which are directed forward over the shoulder portion 54 on either side of the head portion 52, and which cross one another proximate the forward portion of the shoulder portion 54 as illustrated in FIGS. 3A–3B. If desired, an adhesive can be used to secure the bodice member 58 to the shoulder portion 54. For example, glue such as that dispensed from a hot glue gun, can be used to bond the bodice member 58 to the shoulder portion 54 at the point at which the central portion 60 engages the shoulder portion 54.

A belt member 66 is then secured about the first loops 32 and the end portions 62 and 64 of the bodice member 58 to form a waist portion 68. In the illustrated embodiment, the belt member 66 comprises a length of ribbon which is received around the first loops 32 proximate the gathered portion 34, and about the end portions 62 and 64 of the bodice member, and tied in a bow. However, it will be understood that other materials can be used to form the belt member 66 if desired. It will also be understood that the illustrated bodice member 58, is representative of one preferred bodice configuration, and it is contemplated that a more conventionally configured blouse-type bodice could be used to cover selected areas of the shoulder portion 54 and the gathered portions 34 and 42 if desired.

With the belt member 66 secured so as to form the waist portion 68 of the doll, the doll is suitable for display or other use. However, as illustrated in FIGS. 3B and 4, a halo member 70 can be secured to the doll as a further decoration. In the preferred application of the method, the halo member 70 is fabricated from wire, and defines a mounting stem 72 which is secured to the back of the shoulder portion 54, preferably between the shoulder portion 54 and central portion 60 of the bodice member 58. The securing of the halo member can be accomplished with an adhesive, such as glue of the type dispensed by a hot glue gun.

Further, a pair of arm members 74 and 76 can be secured to the doll if desired. In the preferred application of the method, the proximal end portions 78 of the arm members 74 and 76 are secured in the second loops 40C as illustrated in FIG. 3B. In this regard, an adhesive can be used to accomplish the securing of the arm members 74 and 76, such as, for example, glue of a type dispensed by a hot glue gun. Moreover, a harp 80 can be secured in the arm members 74 and 76, as illustrated in FIGS. 3B and 4 as further decoration.

In light of the above, it will be recognized that the present invention provides a doll making method which facilitates the easy and inexpensive construction of an aesthetically pleasing doll. However, while a preferred application of the method has been shown and described, it will be understood that there is no intent to limit the invention to such disclosure, but rather it is intended to cover all modifications and alternate applications or processes falling within the spirit and scope of the invention as defined in the appended claims.

We claim:

1. A doll making method comprising the steps of:

forming a length of ribbon material into a plurality of first loops disposed on opposite sides of a first gathered portion of ribbon material;

folding the ribbon material proximate the first gathered portion whereby the first loops are substantially adjacently disposed so as to define a skirt-like configuration;

forming the ribbon material into a plurality of second loops disposed on opposite sides of a second gathered portion of ribbon material so as to produce first and second oppositely disposed wing-like portions; and securing a head member to the ribbon material proximate the first and second gathered portions of ribbon material.

2. The doll making method of claim 1, further comprising, before the step of securing a head member to the ribbon material, securing the first and second gathered portions of ribbon material together.

3. The doll making method of claim 2 wherein said step of securing the first and second gathered portions of ribbon material together includes binding the first and second gathered portions with a length of bendable wire.

4. The doll making method of claim 1, further comprising, after the step of securing the head member to the ribbon material, securing a bodice member about the first and second gathered portions of ribbon material.

5. The doll making method of claim 4 wherein the head member includes a head portion and a shoulder portion, and wherein said step of securing the bodice member about the first and second gathered portions of ribbon material includes securing the bodice member to the shoulder portion of the head member.

6. The doll making method of claim 3 wherein the bodice member includes a length of ribbon material defining a central portion and opposite end portions, and said step of securing the bodice member about the first and second gathered portions of ribbon material includes placing the central portion of the bodice member into engagement with a rear portion of the shoulder portion of the head member, draping the opposite end portions of the bodice member over the shoulder portion of the head member on either side of the head portion, and crossing one opposite end portion of the bodice member over the other opposite end portion of the bodice member.

7. The doll making method of claim 4, further comprising, after the step of securing the bodice member about the first and second gathered portions, forming a waist portion by securing a belt member about the opposite end portions of the bodice member and about the ribbon material forming the first loops at a position proximate the first gathered portion.

8. The doll making method of claim 7 wherein the belt member defines a length of ribbon which is tied into place about the bodice member and the ribbon material forming the first loops.

9. The doll making method of claim 1 wherein the first loops are of greater length than the second loops.

10. The doll making method of claim 1 wherein said step of forming the ribbon material into a plurality of second loops includes the forming of three second loops on either side of the second gathered portion of ribbon material.

11. The doll making method of claim 1 wherein said step of forming the ribbon material into a plurality of second loops includes the forming of a plurality of pairs of oppositely disposed second loops wherein each said pair of oppositely disposed second loops defines second loops of differing lengths.

12. The doll making method of claim 11 wherein said step of forming the ribbon material into a plurality of second loops includes forming three pairs of oppositely disposed second loops.

13. The doll making method of claim 1 wherein said method includes the further step of securing a first arm member to a second loop on one side of the second gathered portion, and securing a second arm member to a second loop on the opposite side of the second gathered portion.

14. The doll making method of claim 1 wherein said method includes the further step of securing a halo member to the head member.

15. A doll making method, said method utilizing a retaining apparatus including a base member having an upper work surface and including at least a pair of retainer members mounted on the base member and extending upward from the upper work surface, such retainer members being selectively spaced so as to define a retaining gap, said method comprising the steps of:

forming a length of ribbon material into a plurality of first loops disposed on opposite sides of a first gathered portion of the ribbon material whereby the first gathered portion is disposed in the retaining gap of the retaining apparatus so as to be releasably held in position by the retainer members of the retaining apparatus;

folding the ribbon material proximate the first gathered portion whereby the first loops are substantially adjacently disposed so as to define a skirt-like configuration;

forming the ribbon material into a plurality of second loops disposed on opposite sides of a second gathered portion of ribbon material so as to produce first and second oppositely disposed wing-like portions, whereby the second gathered portion is disposed in the retaining gap of the retaining apparatus so as to be releasably held in position by the retainer members of the retaining apparatus;

securing the first and second gathered portions of the ribbon material together;

securing a head member to the ribbon material proximate the first and second gathered portions of ribbon material; and securing a bodice member about the first and second gathered portions of ribbon material.

16. A doll making method comprising the steps of:

forming a length of ribbon material into a plurality of first loops disposed on opposite sides of a first gathered portion of ribbon material;

folding the ribbon material proximate the first gathered portion whereby the first loops are adjacently disposed so as to define a skirt-like configuration;

forming the ribbon material into a plurality of second loops disposed on opposite sides of a second gathered portion of ribbon material so as to produce first and second oppositely disposed wing-like portions;

securing the first and second gathered portions of ribbon material together;

securing a head member to the ribbon material proximate the first and second gathered portions of ribbon material, the head member defining a head portion and a shoulder portion;

forming a bodice member about the first and second gathered portions of ribbon material by placing the central portion of a length of further ribbon material into engagement with a rear portion of the shoulder portion of the head member, draping opposite end portions of the further ribbon material over the shoulder portion of the head member on either side of the head portion, and crossing one opposite end portion of the further ribbon material over the other opposite end portion of the further ribbon material; and forming a waist portion by securing a belt member about the opposite end portions of the further ribbon material and about the ribbon material forming the first loops at a position proximate the first gathered portion.

17. The doll making method of claim 16 wherein the belt member defines a length of ribbon which is tied into place about the bodice member and the ribbon material forming the first loops.

* * * * *